US005079787A

United States Patent [19]

Pollmann

[11] Patent Number: 5,079,787

[45] Date of Patent: Jan. 14, 1992

[54] PRESSURE EQUALIZING SUPPORT STRUCTURE

[75] Inventor: Huibert P. M. Pollmann, Amsterdam, Netherlands

[73] Assignee: Stichting Revalidatiecentrum Amsterdam, Regional Centrum voor Revalidatie, Amsterdam, Netherlands

[21] Appl. No.: 591,422

[22] Filed: Oct. 1, 1990

[30] Foreign Application Priority Data

Oct. 3, 1989 [NL] Netherlands ..... 8902458

[51] Int. Cl.[5] ..... A47C 27/08

[52] U.S. Cl. ..... 5/450; 5/449; 428/71; 206/584; 297/DIG. 1

[58] Field of Search ..... 5/448, 449, 450, 481; 428/71, 313.5, 316.6; 206/814, 584; 297/DIG. 1, 456

[56] References Cited

U.S. PATENT DOCUMENTS

| | | | |
|---|---|---|---|
| 2,865,800 | 12/1958 | Stastny | 428/313.5 |
| 3,480,280 | 11/1969 | Gamertsfelder | 5/449 |
| 3,616,158 | 10/1971 | Robens | 206/584 |
| 4,027,888 | 6/1977 | Wilcox | 297/284 |
| 4,055,866 | 11/1977 | Evans | 5/449 |
| 4,109,332 | 8/1978 | Lück | 5/481 |
| 4,304,824 | 12/1981 | Karpinski | 428/71 |
| 4,432,110 | 2/1984 | Sutton | 5/481 |
| 4,606,087 | 8/1986 | Alivizatos | 5/449 |
| 4,667,356 | 5/1987 | Holmquist | 5/449 |
| 4,862,539 | 9/1989 | Bokich | 5/448 |
| 4,924,541 | 5/1990 | Inagaki | 5/448 |

*Primary Examiner*—Gary L. Smith
*Assistant Examiner*—F. Saether
*Attorney, Agent, or Firm*—Lorusso & Loud

[57] ABSTRACT

A support structure is provided which effects a pressure equalization. It comprises an enclosure filled with a large number of loose pieces. In a special embodiment the loose pieces are surrounded by a low friction material, such as nylon fabric, and are made of a deformable material, preferably foam-material. Another embodiment provides balloon-shaped pieces. Further an outer cover surrounding the enclosure may be provided.

13 Claims, 2 Drawing Sheets

FIG. 3
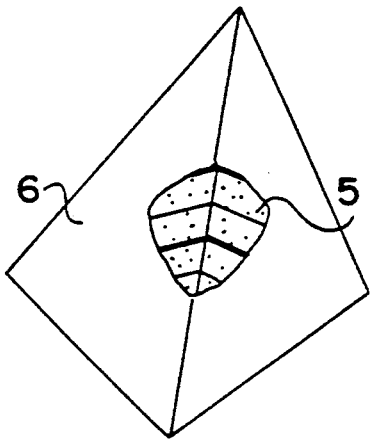
FIG. 4
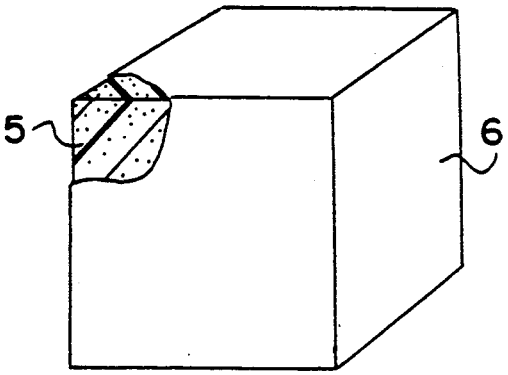
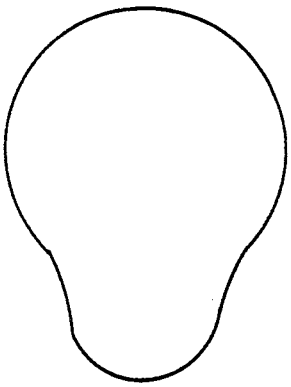
FIG. 5

PRESSURE EQUALIZING SUPPORT STRUCTURE

BACKGROUND OF THE INVENTION

The invention relates to a pressure equalizing support structure. Such pressure equalizing support structures are used for regularly distributing the pressure on a supported body for obtaining a minimal distortion of the body tissue. Like this one tries to avoid bedsores (decubitus).

A known pressure equalizing support structure comprises an internally pressurizable element that at its outer side is provided with projecting burl-shaped parts. This known support structure has several disadvantages. Due to the complicated shape of the projecting burl-shaped parts maintenance of this support structure, especially cleaning thereof, is very difficult. The material thickness required for obtaining sufficient strength renders this known support structure heavy and clumsy. Moreover such a structure often also comprises a heavy water- or gel filling. Further this known support structure has the disadvantage that there is a risk on leakage. Because however such support structures are often sued with persons having paralysis symptoms, such a leakage mostly will not be noted by these persons. Further auxiliary means provided with such a support structure for controlling and monotoring the pressure, such as pumps, render this structure complicated and expensive.

SUMMARY OF THE INVENTION

It is an object of the invention to provide a pressure equalizing support structure which does not have these disadvantages.

As a result the pressure equalizing support structure according to the invention is characterised by loose pieces filled in an enclosure which are practically freely movable relative to each other and relative to the enclosure.

Due to the configuration according to the invention the pressure equalizing support structure has several important advantages. The loose pieces engage each other and the enclosure only with a feable frictional force. So these loose pieces may be shifted easily relative to each other under influence of an external force exerted onto the pressure equalizing support structure. As a result these loose pieces assume a position in which they are subjected to a force equilibrium. The settlement of this for equilibrium is possible because the loose pieces are contained in the enclosure. Due to this force equilibrium the support structure, or more specially the loose pieces provided therein, exerts a regular pressure onto the body of a person on top of this support structure. When this person changes its position the loose pieces will shift relative to each other too, until a new force equilibrium has developped. For the person it feels as if the support structure contains a viscous liquid. In practice it appears that, when using the support structure according to the invention, no or hardly any bedsores occur. The regular pressure distribution at one hand and the absence of shear forces because the enclosure can shift relative to the loose pieces at the other hand result in a minimal distortion of the body tissue of a supported person.

The support structure according to the invention can not leak. Thus it maintains its capability when the enclosure is damaged by a sharp object. Further, due to the chosen configuration, the support structure is lightweighted, such that handling it is easy. Complicated auxiliary means, such as pumps or the like, are absent As a result using this support structure is simple and also a layman can operate this support structure without problems. Finally the support structure according to the invention is cheaper than the known support structures.

DETAILED DESCRIPTION OF THE INVENTION

In a preferred embodiment of the support structure according to the invention it is characterised in that each separate loose piece is surrounded by a low friction material Due to the application of this material (a coating firmly attached to the pieces) the mutual friction between the loose pieces and the friction between the loose pieces and the enclosure is further reduced, hence further reducing the shear forces exerted onto the body tissue of a supported person. Thus obtaining a force equilibrium may even be enhanched, such that an optimal support of the body occurs while extremely regularly distributing the pressure.

Preferably the material comprises a plastic material, such as nylon fabric or the like. Further it is possible that this material comprises spinnaker fabric. In such a case the loose pieces each can be contained in bags or the like made of such a fabric.

Further it is advantageous if the loose pieces are made of a deformable material. This deformable material may comprise foam material, such as polyether foam or the like. Due to the application of such a deformable material the rigidness of the support structure may be varied. Depending on whether the support structure has to be softer or harder a material is applied being more or less deformable. In this way the amount of sinking of a supported body can be controlled.

In a production technical point of view a simple embodiment comprises loose pieces which are substantially cubical. Moreover it is possible that the loose elements are substantially tetrahedron-shaped thus obtaining an optimal relative slidability thereof.

Further it is possible that the loose pieces are substantially ball-shaped or balloon-shaped and inflated with air or the like.

The enclosure 2 may be made of a plastic material, such as nylon fabric or the like. Again spinnaker fabric may be used. Such an enclosure contributes in still further lowering occuring shear forces.

To minimize occuring shear forces in an optimal way it is possible, that the enclosure is surrounded by an outer cover. That outer cover, which again may be made of a low friction plastic material, such as a nylon fabric or the like, can very easily slide relative to the enclosure. As a result it can be prohibited that a so-called hammock-effect occurs at the skin of a supported person.

If, in correspondence with another advantageous embodiment of the support structure according to the invention, the enclosure, and optionally the outer cover, is (are) provided with a closable filling opening, it is possible to vary the filling degree of the support structure. As a result an extra possibility is obtained to increase or lower the rigidness of the support structure.

The support structure according to the invention using an enclosure and optionally an outer cover is in general permeable to air. This means that when a person loads the support structure air is expelled out of the enclosure and the outer cover, such that the support structure as it were partially goes flat. Then the body of the supported person is slowly lowered into the support structure, such that an optimal adaption of the shape of the support structure to the body is obtained.

As has been noted previously the support structure according to the invention will be considerably cheaper than the presently known pressure equalizing support structures. This is also due to the fact that for manufacturing the support structure according to the invention one may use a cheap production process, in which non-complicated techniques can be applied, such as sewing and sealing. Moreover it is rather simple to adapt the shape of the support structure in consequence of its specific use. One may consider application in wheelchairs, for example for supporting a stretched leg, in adapted chairs and armchairs and for cushions in swimming pools, cars and the like. Further one can think of applications in operating-tables, operating-chairs, dentist-chairs and stretchers. Moreover, due to its support nearly free of shear forces the support structure according to the invention is extremely fitted for application in centers for burns.

Apart from the above-mentioned clinical applications of the support structure according to the invention it also has a number of non-clinical applications, such as in conventional mattresses or as an alternative for waterbeds, thus avoiding the disadvantageous swaying of such waterbeds. Further one can consider applications in which a lengthly stable seat is required, such as in carseats, truckseats or the like.

DETAILED DESCRIPTION OF THE DRAWINGS

Hereinafter the invention will be elucidated further with reference to the drawing, in which an embodiment of the support structure according to the invention is illustrated.

FIG. 3 shows on a larger scale a tetrahedron-shaped loose piece with a portion of the low friction material broken away as applied in the support structure according to the present invention.

FIG. 4 shows a larger scale a cubical-shaped loose piece with a portion of the low friction material broken away as applied in the support structure according to the present invention.

FIG. 5 shows on a larger scale a balloon-shaped loose piece inflated with air as applied in the support structure according to the present invention.

Figure 1:
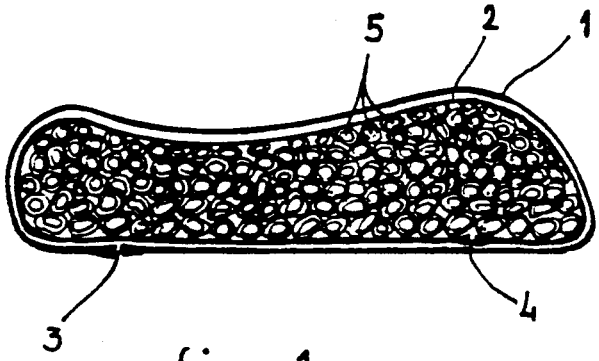
FIG. 1 shows a cross-section through an embodiment of the support structure according to the invention shaped as a cushion.

As appears clearly in FIG. 1 the pressure equalizing support structure comprises an outer cover 1 surrounding an enclosure 2. The outer cover 1 and the enclosure 2 both are provided with a closable filling opening 3 and 4, respectively. These filling openings 3 and 4 may comprise a zipper or the like.

The outer cover 1 and the enclosure 2 engage each other along their entire surface, however are not attached to each other. Thus, when the support structure is loaded by a person, the outer cover 1 can shift relative to the enclosure 2. Like this shear forces on the skin of a supported person are effectively avoided.

Figure 2:
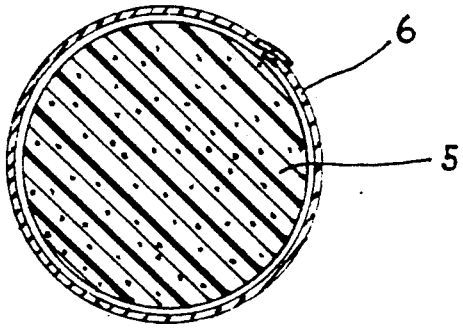
FIG. 2 shows on a larger scale a cross-section through a piece as applied in the support structure according to FIG. 1.

Within the enclosure 2 a large amount of loose pieces 5 is provided. Each loose piece 5 is surrounded by a smooth material, for example shaped as a bag 6 (see FIG. 2). These bags can be sewed up or glued. Further these bags may be obtained by means of a seal operation or the like.

The loose pieces 5 create a compact, but nevertheless easily deformable mass in the enclosure 2 that as is were behaves as a viscous fluid. Because the bags 6 are manufactured of a smooth material they can shift easily relative to each other.

A smooth plastic material, such as nylon fabric, is preferred for the outer cover 1, the enclosure 2 and bags 6. The loose pieces 5 itself may be made of a foam material, such as polyether foam or the like. The loose pieces 5 can be cubical or tetrahedron-shaped, but also ball-shaped or balloon-shaped in which latter case the pieces may be inflated with air. When choosing the shape of the loose pieces 5 one should always take into account the requirement that these loose pieces 5 have to be easily shiftable relative to each other within the enclosure 2. The dimensions of the pieces 5 may vary and an advantageous dimension when using a cubical piece appeared to be an edge of about 5 cm.

The invention is not restricted to the embodiment described before, which can be varied widely within the scope of the invention. Thus it is possible that the enclosure and optionally the outer cover is (are) at least partially made of an elastic material. Due to this an attenuating effect can be obtained.

I claim:

1. Pressure equalizing support structure, comprising loose pieces filled in an enclosure, said loose pieces being surrounded by a low friction fabric material which are freely movable relative to each other and relative to the enclosure.

2. Support structure according to claim 1, wherein the low friction fabric material comprises a plastic material, such as nylon fabric.

3. Support structure according to claim 1, wherein the loose pieces are made of a deformable material.

4. Support structure according to claim 3, wherein the deformable material comprises a foam material, such as polyether foam.

5. Support structure according to claim 1, wherein the loose pieces are cubical or tetrahedron-shaped.

6. Support structure according to claim 1, wherein the loose pieces are ball-shaped or balloon-shaped.

7. Support structure according to claim 1, wherein the enclosure is made of a plastic material, such as nylon fabric.

8. Support structure according to claim 1, wherein the enclosure is surrounded by an outer cover.

9. Support structure according to claim 8, wherein the outer cover is made of a low friction plastic material, such as nylon fabric.

10. Support structure according to claim 1, wherein the enclosure is provided with a closable filling opening.

11. Support structure according to claim 1, wherein the enclosure is made of an elastic material.

12. Support structure according to claim 8 wherein the outer cover is provided with a closable filling opening.

13. Support structure according to claim 8 wherein the outer cover is made of an elastic material.

* * * * *